US009719329B2

(12) United States Patent
Hradecky

(10) Patent No.: US 9,719,329 B2
(45) Date of Patent: Aug. 1, 2017

(54) DOWNHOLE TOOL STRING BUOYANCY APPARATUS

(71) Applicant: Impact Selector International, LLC, Houma, LA (US)

(72) Inventor: Jason Allen Hradecky, The Woodlands, TX (US)

(73) Assignee: Impact Selector International, LLC, Houma, LA (US)

( * ) Notice: Subject to any disclaimer, the term of this patent is extended or adjusted under 35 U.S.C. 154(b) by 0 days.

(21) Appl. No.: 14/856,911

(22) Filed: Sep. 17, 2015

(65) Prior Publication Data

US 2016/0084013 A1 Mar. 24, 2016

Related U.S. Application Data

(60) Provisional application No. 62/052,851, filed on Sep. 19, 2014.

(51) Int. Cl.
*E21B 41/00* (2006.01)

(52) U.S. Cl.
CPC ..... *E21B 41/00* (2013.01)

(58) Field of Classification Search
CPC ..... E21B 17/006; E21B 17/10; E21B 19/00; E21B 17/1078; E21B 41/00; E21B 41/0007
See application file for complete search history.

(56) References Cited

U.S. PATENT DOCUMENTS 1,764,488 A * 6/1930 Zublin ..... E21B 17/00 175/325.3
3,528,499 A * 9/1970 Collett ..... E21B 17/105 166/175
3,957,112 A 5/1976 Knibbe et al.
4,176,986 A 12/1979 Taft et al.
4,308,917 A * 1/1982 Dismukes ..... E21B 43/10 166/242.1
5,456,317 A * 10/1995 Hood, III ..... E21B 7/04 166/296
6,367,846 B1 4/2002 Aaron, III
6,402,431 B1 * 6/2002 Nish ..... E21B 17/012 405/224.3
6,439,810 B1 8/2002 Nish et al.
6,443,244 B1 * 9/2002 Collins ..... E21B 17/00 166/367
7,228,918 B2 * 6/2007 Evans ..... E21B 7/068 175/61
7,328,747 B2 2/2008 Jones et al.
(Continued)

*Primary Examiner* — Matthew R Buck
(74) *Attorney, Agent, or Firm* — Boisbrun Hofman, PLLC

(57) ABSTRACT

A buoyancy apparatus operable for connecting to a downhole tool string conveyable within a wellbore extending into a subterranean formation. The buoyancy apparatus comprises a mandrel having an axially extending bore, a first connector disposed at a first end of the mandrel and operable for connecting the buoyancy apparatus to a first portion of the downhole tool string, and a second connector disposed at a second end of the mandrel and operable for connecting the buoyancy apparatus to a second portion of the downhole tool string. A shell extends around the mandrel to define an annular space between the shell and the mandrel. A buoyant material is retained within in the annular space.

1 Claim, 7 Drawing Sheets

(56) References Cited

U.S. PATENT DOCUMENTS 8,690,481 B2 * 4/2014 Begley ..... E21B 17/012
405/195.1
8,800,664 B2 * 8/2014 Gollmyer ..... E21B 17/1064
166/335

* cited by examiner

DOWNHOLE TOOL STRING BUOYANCY APPARATUS

CROSS-REFERENCE TO RELATED APPLICATIONS

This application claims priority to and the benefit of U.S. Provisional Application No. 62/052,851, titled "Downhole Tool String Buoyancy Apparatus," filed Sep. 19, 2014, the entire disclosure of which is hereby incorporated herein by reference.

BACKGROUND OF THE DISCLOSURE

Wells are generally drilled into a surface (land-based) location or ocean bed to recover natural deposits of oil and gas, as well as other natural resources that are trapped in geological formations in the Earth's crust. Testing and evaluation of completed and partially finished wellbores has become commonplace, such as to increase well production and return on investment. Information about the subsurface formations, such as measurements of the formation pressure, formation permeability, and recovery of formation fluid samples, may be useful for predicting the economic value, the production capacity, and production lifetime of a subsurface formation. Downhole tools, such as formation testers, may perform evaluations in real-time during sampling of the formation fluid.

These testing and evaluation operations have become increasingly expensive as wellbores are drilled deeper and through more difficult materials. In working with deeper and more complex wellbores, it becomes more likely that tool strings, tools, and/or other downhole apparatuses may include numerous testing, navigation, and/or other tools, resulting in longer and/or heavier tool strings. These tool strings may require larger and/or more powerful surface devices, such as tensioning devices, to support and/or convey these tool string into and out of a wellbore. Furthermore, as wellbores are drilled in increasingly harsher and remote environments, larger and/or more powerful surface devices may not be transportable to and/or installable at well sites located in such environments. Therefore, surface devices that may be underpowered and/or unable to convey tool strings into and out of the wellbores in optimal manner may be used at the well sites located in such environments.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
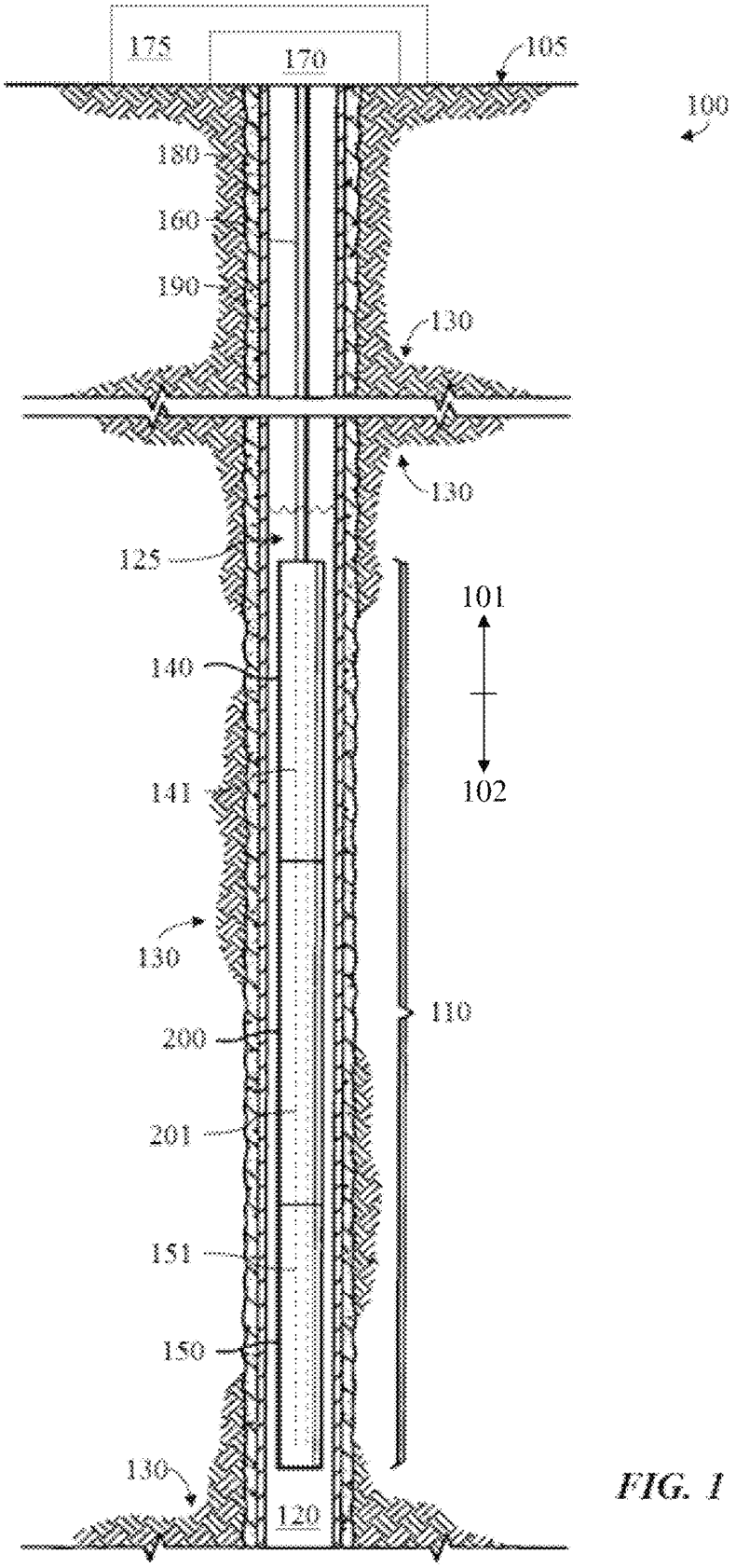
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

FIG. 1 is a sectional view of at least a portion of an implementation of a wellsite system 100 according to one or more aspects of the present disclosure. The wellsite system 100 comprises a tool string 110 suspended within a wellbore 120 that extends from a wellsite surface 105 into one or more subterranean formations 130. The tool string 110 may comprise a first portion 140, a second portion 150, and a buoyancy apparatus 200 coupled between the first portion 140 and the second portion 150, wherein the buoyancy apparatus 200 may be operable to introduce buoyancy to the tool string 110 to oppose the weight of the tool string 110 when the tool string is submerged within a wellbore fluid 125. The tool string 110 is shown suspended within the wellbore 120 via conveyance means 160 operably coupled with a tensioning device 170 and/or other surface equipment 175 disposed at the wellsite surface 105.

The wellbore 120 is depicted in FIG. 1 as being a cased-hole implementation comprising a casing 180 secured by cement 190. However, one or more aspects of the present disclosure are also applicable to and/or readily adaptable for utilizing in open-hole implementations lacking the casing 180 and cement 190.

The tensioning device 170 is operable to apply an adjustable tensile force to the tool string 110 in an uphole direction 101 via the conveyance means 160. Although depicted schematically in FIG. 1, a person having ordinary skill in the art will recognize the tensioning device 170 as being, comprising, or forming at least a portion of a crane, winch, drawworks, top drive, and/or other lifting device coupled to the tool string 110 by the conveyance means 160.

The conveyance means 160 is or comprises wireline, slickline, e-line, coiled tubing, drill pipe, production tubing, and/or other conveyance means, and comprises and/or is operable in conjunction with means for communication between the tool string 110 and the tensioning device 170 and/or one or more other portions of the various surface equipment 175.

The first and second portions 140 and 150 of the tool string 110 may each be or comprise one or more downhole tools, modules, and/or other apparatus operable in wireline, while-drilling, coiled tubing, completion, production, and/or other implementations. The first portion 140 of the tool string 110 may also comprise at least one electrical conductor 141 in electrical communication with at least one component of the surface equipment 175, and the second portion 150 of the tool string 110 may also comprise at least one electrical conductor 151 in electrical communication with at least one component of the surface equipment 175, wherein the at least one electrical conductor 141 of the first portion 140 of the tool string 110 and the at least one electrical conductor 151 of the second portion 150 of the tool string 110 may be in electrical communication via at least one or more electrical conductors 201 extending through the buoyancy apparatus 200. Thus, the one or more electrical conductors 141, 201, 151, and/or others may collectively extend from the conveyance means 160 and/or the first tool string portion 140, into the buoyancy apparatus 200, and perhaps into the second tool string portion 150, and may include various electrical connectors along such path. Although three electrical conductors are depicted in FIG. 1, the drill string may comprise a single continuous electrical conductor extending through the first portion 140, the buoyancy apparatus 200, and the second portion 150.

The buoyancy apparatus 200 may be employed to increase the buoyancy of the tool string 110 when submerged within the wellbore fluid 125. Buoyancy is an upward force exerted by the wellbore fluid 125 on the buoyancy apparatus 200 and is equal to the weight of the wellbore fluid 125 displaced by the buoyancy apparatus 200 minus the weight of the buoyancy apparatus 200. Accordingly, the buoyancy apparatus 200 may be operable to decrease the amount of tension and, therefore, energy necessary for the tensioning device 170 to lift the tool string 110 in an uphole direction 101 via the conveyance means 160. The buoyancy apparatus 200 may also be operable in deviated and/or horizontal wells (not shown) to decrease the amount of friction force generated between the tool string 110 and the sidewalls of the deviated and/or horizontal wells. Thus, by decreasing the friction between the tool string 110 and the deviated and/or horizontal wells, the amount of force and, therefore, energy necessary to move the tool string 110 in the uphole and/or downhole directions 101, 102 may be reduced.

Although FIG. 1 depicts the buoyancy apparatus 200 being coupled between the first and second portions 140, 150 of the tool string 110, the buoyancy apparatus 200 may be coupled elsewhere along the tool string, whether in an uphole or downhole direction with respect to the first and the second portions 140, 150 of the tool string 110. Moreover, two or more buoyancy apparatuses 200 may also be coupled along the tool string 110, such as in implementations in which an instance of the buoyancy apparatus is disposed at each of the uphole and downhole ends of the tool string 110.

In use, one or more buoyancy apparatuses 200 may be coupled to the tool string 110 before the tool string 110 is conveyed into the wellbore. For example, the buoyancy apparatus 200 may be operable in a tool string 110 in prophylactic applications (as opposed to "fishing" applications), such that should a portion of the tool string 110 (e.g., the second portion 150) become lodged or stuck in the wellbore 120, the first portion 140 of the tool string 100 may be a jar tool operable to impart an impact to the tool string 110 in an attempt to dislodge the stuck portion.

The tool string 110 may also comprise various quantities and types of other downhole tools, including as part of those schematically depicted in FIG. 1 as the first and second portions 140, 150 and/or other portions. The first and second portions 140, 150 may be or comprise an acoustic tool, a density tool, a directional drilling tool, a drilling tool, an EM tool, a formation evaluation tool, a gravity tool, a formation logging tool, a magnetic resonance tool, a formation measurement tool, a monitoring tool, a neutron tool, a nuclear tool, a photoelectric factor tool, a porosity tool, a reservoir characterization tool, a resistivity tool, a seismic tool, a surveying tool, a telemetry tool, and/or a tough logging condition (TLC) tool, although other downhole tools are also within the scope of the present disclosure.

Figure 2:
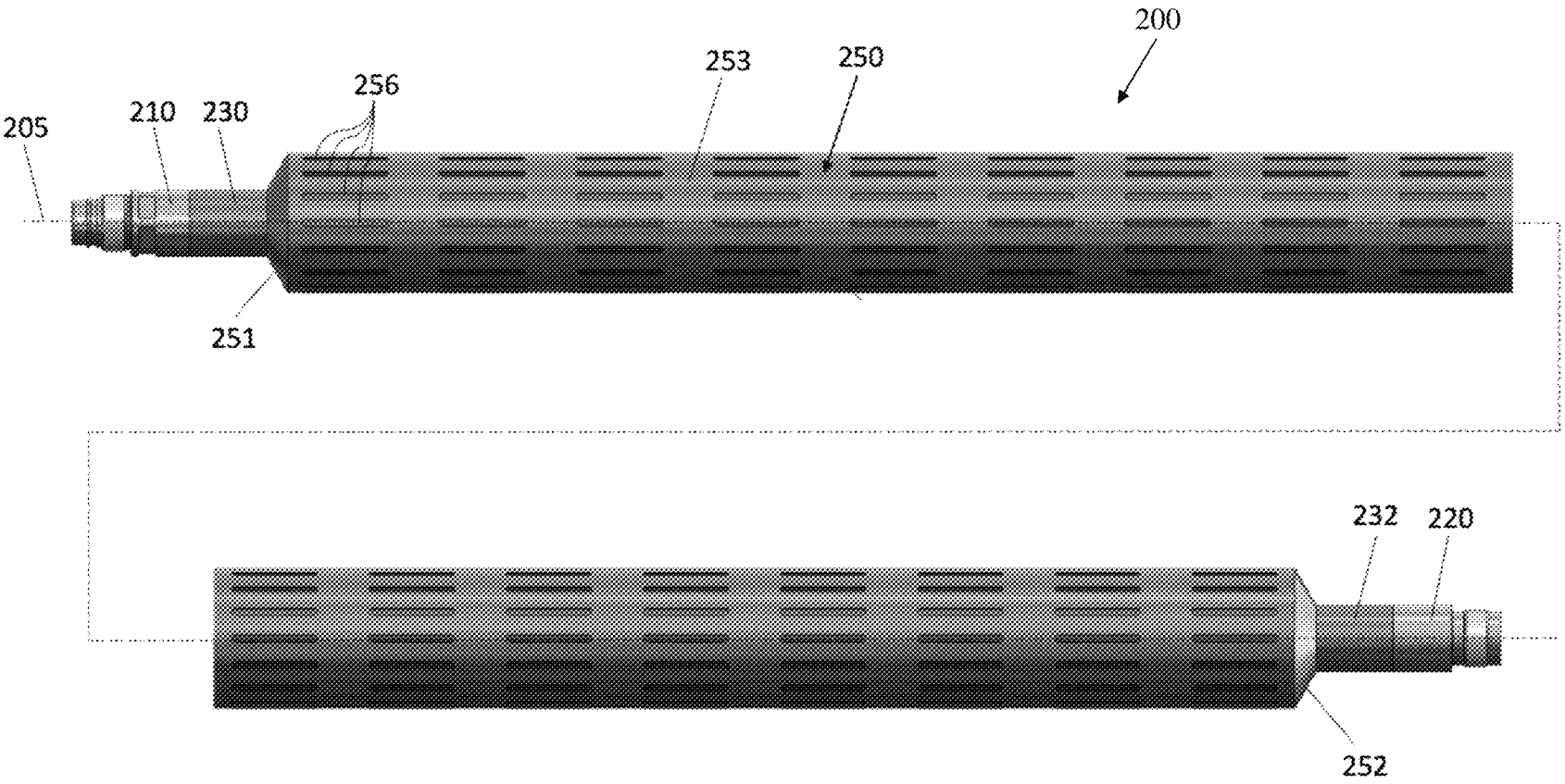
FIG. 2 is a side view of an example implementation of a portion of the apparatus shown in FIG. 1 according to one or more aspects of the present disclosure.
Figure 3:
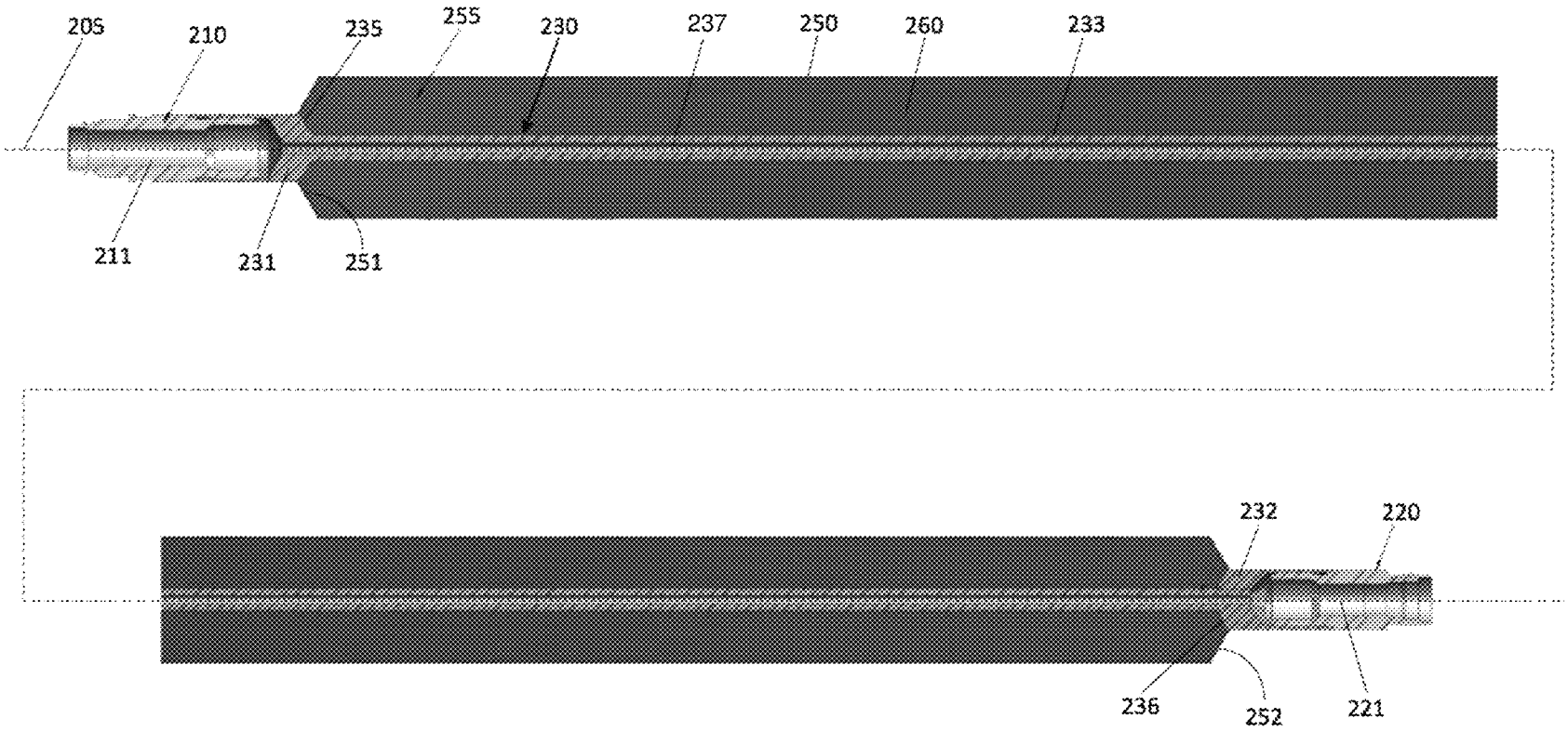
FIG. 3 is a sectional view of an example implementation of a portion of the apparatus shown in FIG. 1 according to one or more aspects of the present disclosure.

FIGS. 2 and 3 are side and sectional views, respectively, of at least a portion of an example implementation of the buoyancy apparatus 200 shown in FIG. 1. Referring to FIGS. 1-3, collectively, the buoyancy apparatus 200 comprises a mandrel 230 extending axially along the length of the buoyancy apparatus 200 between an uphole (hereinafter "upper") field connector 210 and a downhole (hereinafter "lower") field connector 220. The mandrel 230 may be substantially tubular, and may comprise an upper portion 231, a lower portion 232, a central portion 233, and at least one central passage 237 extending axially along the length of the upper, lower, and central portions 231, 232, 233. The upper and lower end portions 231, 232 comprise an outer diameter that may be significantly larger than the outside diameter of the central portion 233. The upper and lower portions 231, 232 may be coupled with or otherwise fixedly connected with the central portion 233 via threaded means, fasteners, pins, press/interference fit, and/or other means known in the art. The upper and lower portions 231, 232 may also be integrally formed with the central portion 233. The mandrel 230 may be operable to support tensile and/or compression loads, and the central passage 237 may be operable to receive one or more electrical conductors 201 therethrough.

The upper end portion 231 of the mandrel 230 may be coupled with or otherwise fixedly connected with the upper field connector 210, via threaded means, fasteners, pins, press/interference fit, and/or other means known in the art. The upper field connector 210 may be operable to physically and/or fluidly couple the buoyancy apparatus 200 with the first portion 140 of the tool string 110 or with the conveyance means 160. The upper field connector 210 may comprise an axial throughbore 211, such as may allow fluid communication between the first portion 140 of the tool string 110 or the conveyance means 160 and the central passage 237 of the mandrel 230. The upper field connector 210 may comprise a push-to-connect fluid coupling, a female thread, a male thread, and/or other fluid interface operable to mechanically, electrically, and/or fluidly couple the buoyancy apparatus 200 with a corresponding field connector (not shown) of the first portion 140 of the tool string 110 or with the conveyance means 160.

Similarly, the lower end portion 232 of the mandrel 230 may be coupled with or otherwise fixedly connected with the lower field connector 220 via threaded means, fasteners, pins, press/interference fit, and/or other means known in the art. The lower field connector 220 may be operable to physically and/or fluidly couple the buoyancy apparatus 200 with the second portion 150 of the tool string 110 or to receive a plug or an end cap (not shown) to prevent wellbore fluid 125 from entering the central passage 237 of the mandrel 230. The lower field connector 220 may comprise an axial throughbore 221, such as may allow fluid communication between the second portion 150 of the tool string 110 and the central passage 237 of the mandrel 230. The lower field connector 220 may comprise a push-to-connect fluid coupling, a female thread, a male thread, and/or other fluid interface operable to mechanically, electrically, and/or fluidly couple the buoyancy apparatus 200 with a corresponding field connector (not shown) of the second portion 150 of the tool string 110.

The buoyancy apparatus 200 may further comprise an outer shell 250 circumferentially extending about the central portion 233 of the mandrel 230 between the upper and lower end portions 231, 232 of the mandrel 230. FIGS. 2 and 3 depict the outer shell 250 comprising an upper portion 251, a lower portion 252, and a central portion 253, although other arrangements are also within the scope of the present disclosure. The upper and/or lower portions 251, 252 may be rounded, sloped, tapered, slanted, and/or otherwise shaped, with respect to a central longitudinal axis 205 of the buoyancy apparatus 200, so as to decrease drag/friction forces between the buoyancy apparatus 200 and the wellbore as the buoyancy apparatus 200 moves therethrough.

The central portion 253 may be substantially cylindrical and comprise a plurality of slits, apertures, and/or other openings 256, such as may reduce the weight of the buoyancy apparatus 200 and/or allow wellbore fluid to communicate therethrough into the annular space 255. The openings 256 may also allow pressure compensation between the annular space 255 and the wellbore fluid 125. The openings 256 may be located along the circumference of the central portion 253 of the outer shell 250 and/or along the length of the central portion 253 of the outer shell 250. Although FIG. 2 depicts the openings 256 as slits, the openings 256 may comprise other shapes, including, but not limited to circles, ovals, squares, rectangles, and/or non-geometric shapes, which may be smaller or larger than depicted.

Figure 5:
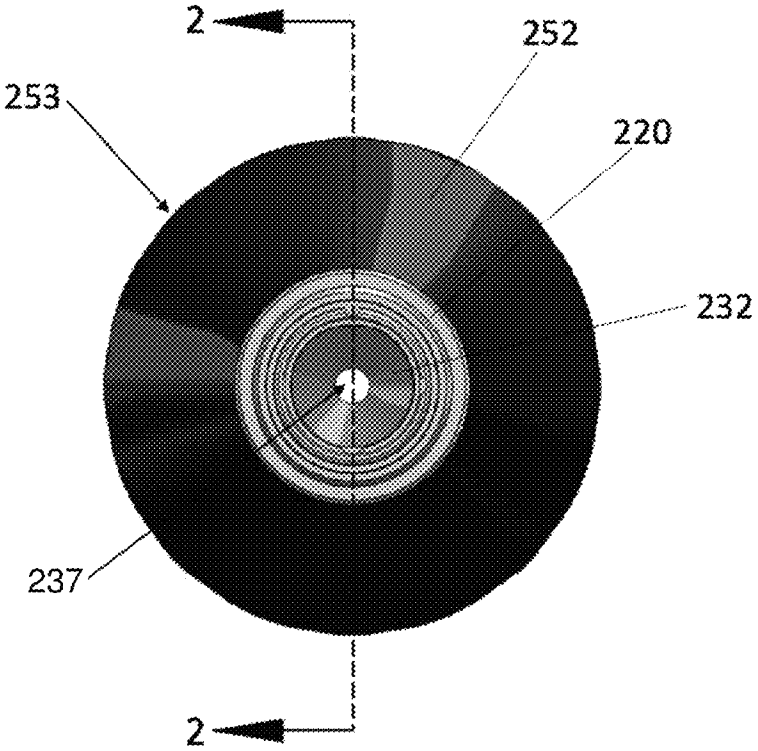
FIG. 5 is an enlarged lower view of a portion of the apparatus shown in FIG. 2 according to one or more aspects of the present disclosure.
Figure 4:
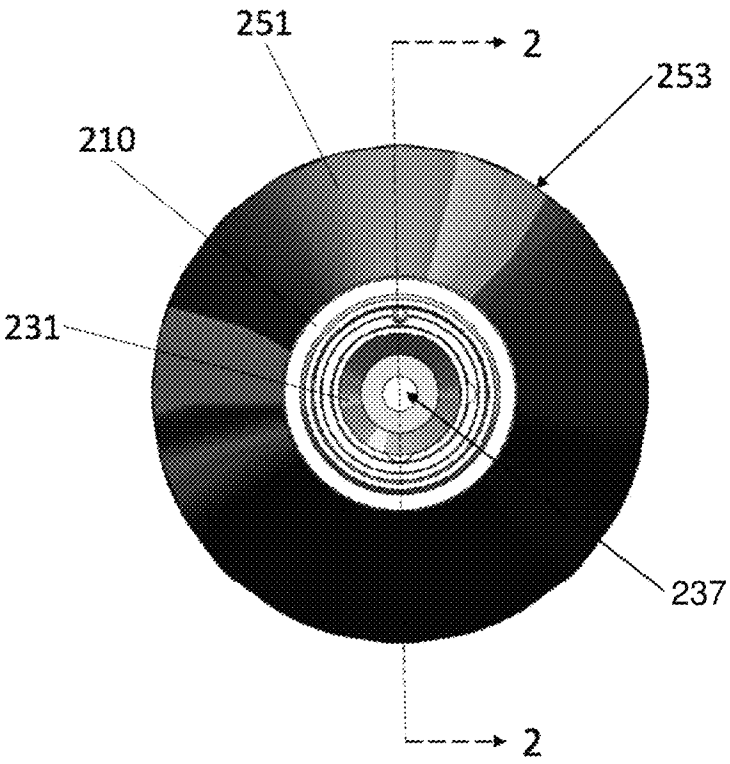
FIG. 4 is an enlarged upper view of a portion of the apparatus shown in FIG. 2 according to one or more aspects of the present disclosure.

FIGS. 4 and 5 are enlarged upper and lower views, respectively, of the apparatus 200 shown in FIGS. 2 and 3 according to one or more aspects of the present disclosure. Referring to FIGS. 1-5, collectively, the central portion 253 of the outer shell 250 may have an outer diameter that is substantially larger than the outer diameters of the upper, lower, and central portions 231, 232, 233 of the mandrel 230 to define an annular space 255 extending between the outer shell 250 and the mandrel 230. The annular space 255 may contain therein one or more solid foam materials, cellular materials, and/or other buoyant materials 260 that are substantially less dense than the wellbore fluid 125, thus generating buoyancy when submerged in the wellbore fluid 125. For example, the buoyant material 260 may be or comprise a blend of syntactic foam and/or other metal, polymer, or ceramic matrix containing hollow particles. The outer shell 250 may be operable to retain and/or protect the buoyant material 260 located within the buoyancy apparatus 200. For example, the outer shell 250 may protect the buoyant material 260 from abrasion against the sidewall of the wellbore 120 as the buoyancy apparatus 200 moves through the wellbore 120 in the uphole and/or downhole directions 101, 102.

The buoyant material 260 may be further retained in position by upper and lower shoulders 235, 236 extending radially between the central portion 233 of the mandrel 230 and the upper and lower portions 231, 232 of the mandrel 230. The upper and lower shoulders 235, 236 may prevent the buoyant material 260 from moving axially along the mandrel 230 such as by physically retaining the buoyant material 260 between the upper and lower shoulders 235, 236.

Figure 6:
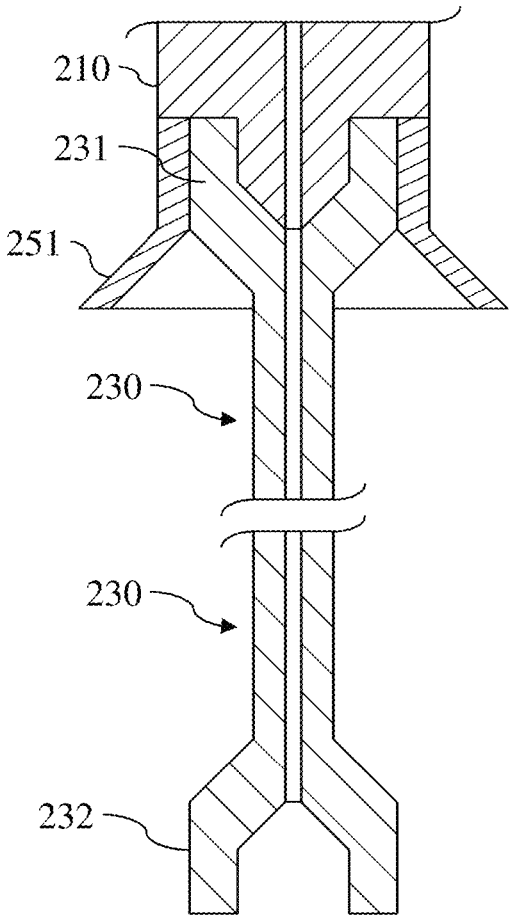
FIGS. 6-8 are sectional views of the apparatus shown in FIGS. 2-5 in sequential stages of an example implementation of a method of assembly.
Figure 7:
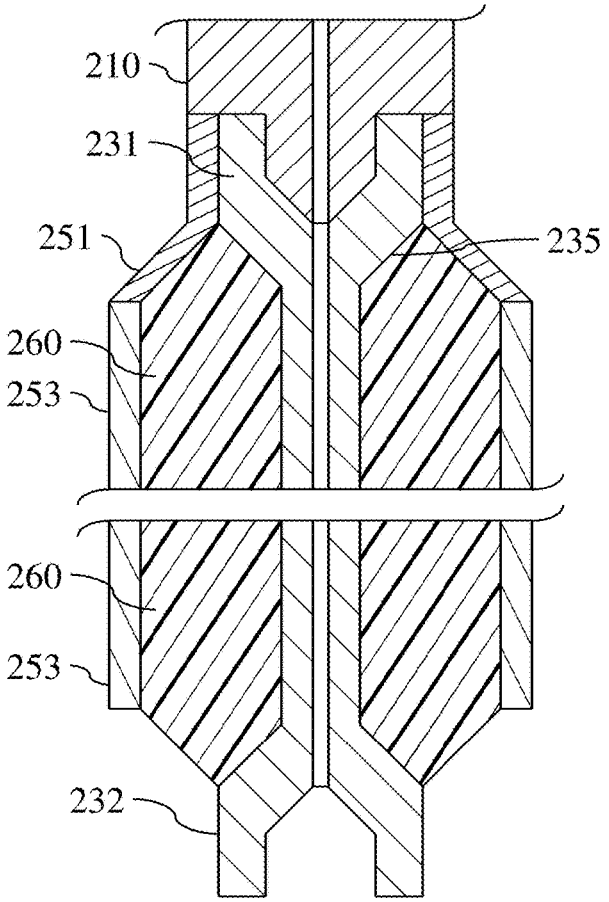
Figure 8:
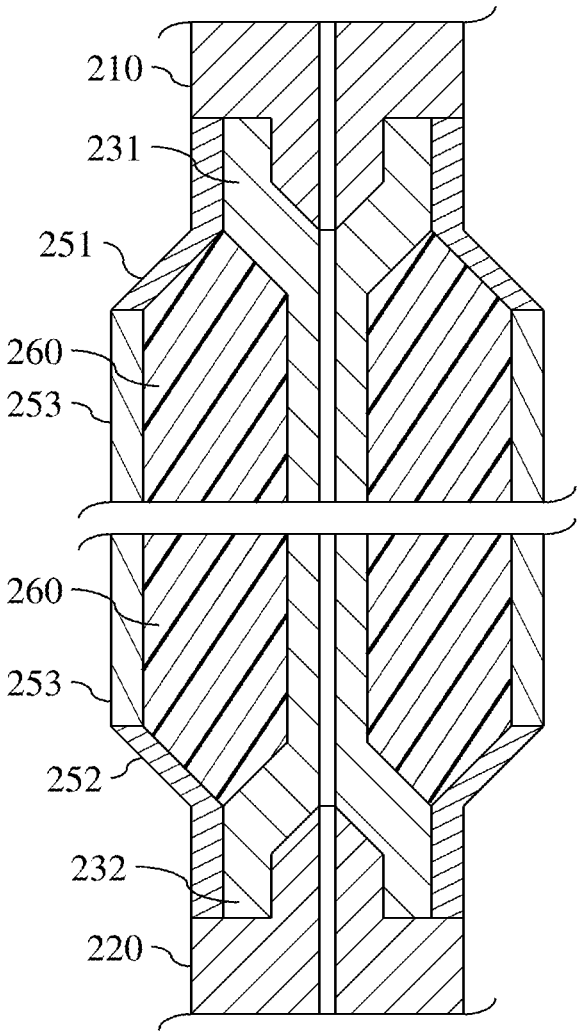

FIGS. 6-8 depict an example implementation of a method of assembling the buoyancy apparatus 200 according to one or more aspects of the present disclosure. In FIG. 6, the upper portion 251 of the outer shell 250 has been attached to the upper end 231 of the mandrel 230. For example, the upper portion 251 of the outer shell 250 may be threaded onto the upper end 231 of the mandrel 230, although other means for attaching the upper portion 251 of the outer shell 250 to the upper end 231 of the mandrel 230 are also within the scope of the present disclosure. The upper portion 251 of the outer shell 250 may also be simply slid onto the upper end 231 of the mandrel 230. After positioning the upper portion 251 of the outer shell 250 around the upper end 231 of the mandrel 230, the upper field connector 210 may be connected to the upper end 231 of the mandrel 230, such as by engaging corresponding threads (not shown) of the upper field connector 210 and the upper end 231 of the mandrel 230. Attaching the upper field connector 210 to the upper end 231 of the mandrel 230 may also retain the upper portion 251 of the outer shell 250 from moving axially upward relative to the upper end 231 of the mandrel 230, such as in implementations in which the upper portion 251 of the outer shell 250 is not threadedly or otherwise engaged directly with the upper end 231 of the mandrel 230.

As depicted in FIG. 7, the annular-shaped buoyant material 260 is then positioned around the mandrel 230. For example, the buoyant material 260 may be sufficiently pliable so as to permit sliding the buoyant material 260 over the lower end 232 of the mandrel 230 until the buoyant material 260 contacts the upper portion 251 of the outer shell 250 and/or the upper shoulder 235 of the mandrel. However, the buoyant material 260 may also comprise multiple longitudinally extending segments collectively positioned around the mandrel 230.

Thereafter, the central portion 253 of the outer shell 250 may be positioned around the buoyant material 260. For example, the central portion 253 of the outer shell 250 may be positioned around the buoyant material 260 by sliding the central portion 253 of the outer shell 250 over the lower end 232 of the mandrel 230 and the buoyant material 260 until the central portion 253 of the outer shell 250 contacts the upper portion 251 of the outer shell 250.

As depicted in FIG. 8, the lower portion 252 of the outer shell 250 is then attached to the lower end 232 of the mandrel 230. For example, the lower portion 252 of the outer shell 250 may be threaded onto the lower end 232 of the mandrel 230, although other means for attaching the lower portion 252 of the outer shell 250 to the lower end 232 of the mandrel 230 are also within the scope of the present disclosure. The lower portion 252 of the outer shell 250 may also be simply slid onto the lower end 232 of the mandrel 230. After positioning the lower portion 252 of the outer shell 250 around the lower end 232 of the mandrel 230, the lower field connector 220 may be connected to the lower end 232 of the mandrel 230, such as by engaging corresponding threads (not shown) of the lower field connector 220 and the lower end 232 of the mandrel 230. Attaching the lower field connector 220 to the lower end 232 of the mandrel 230 may also retain the lower portion 252 of the outer shell 250 from moving axially downward relative to the lower end 232 of the mandrel 230, such as in implementations in which the lower portion 252 of the outer shell 250 is not threadedly or otherwise engaged directly with the lower end 232 of the mandrel 230.

In view of the entirety of the present disclosure, including the figures and the claims, a person having ordinary skill in the art should readily recognize that the present disclosure introduces an apparatus comprising: a buoyancy apparatus operable for connecting to a downhole tool string conveyable within a wellbore extending into a subterranean formation, wherein the buoyancy apparatus comprises: a mandrel having an axially extending bore; a first connector disposed at a first end of the mandrel and operable for connecting the buoyancy apparatus to a first portion of the downhole tool string; a second connector disposed at a second end of the mandrel and operable for connecting the buoyancy apparatus to a second portion of the downhole tool string; a shell extending around the mandrel to define an annular space between the shell and the mandrel; and a buoyant material in the annular space.

The first connector may be fixedly connected with the first end of the mandrel, and the second connector may be fixedly connected with the second end of the mandrel.

The buoyant material may comprise solid foam.

The buoyant material may comprise syntactic foam.

The buoyant material may comprise a metal, polymer, or ceramic matrix containing hollow particles.

The shell may extend axially along a substantial portion of the mandrel between the first and second connectors.

The shell may comprise a plurality of openings through which fluid in the wellbore may flow into the annular space. The plurality of openings may comprise a plurality of slits each extending longitudinally along the shell.

The shell may comprise a first portion proximate the first end of the mandrel, a second portion proximate the second end of the mandrel, and a central portion connected to and extending axially between the first and second portions. The first portion may taper in a first axial direction away from the first end of the mandrel and towards the shell, and the second portion may taper in a second axial direction away from the second end of the mandrel and towards the shell.

The mandrel may further comprise a central portion extending axially between the first and second ends of the mandrel. A substantial portion of the first end of the mandrel may be substantially annular, having a first substantially cylindrical outer surface substantially having a first outer diameter. A substantial portion of the second end of the mandrel may be substantially annular, having a second substantially cylindrical outer surface substantially having the first outer diameter. A substantial portion of the central portion of the mandrel may be substantially annular, having a third substantially cylindrical outer surface substantially having a second outer diameter. The first diameter may be substantially larger than the second diameter, such as by at least about 200%. The buoyant material may be disposed around the third substantially cylindrical outer surface but neither of the first and second substantially cylindrical outer surfaces. The first and second ends of the mandrel and the central portion of the mandrel may be integrally formed as a single discrete member. A first shoulder may be defined by at least one of the first end of the mandrel and the central portion of the mandrel, and an outer profile of the first shoulder may be defined by a first edge having the first outer diameter and a second edge having the second outer diameter. A second shoulder may be defined by at least one of the second end of the mandrel and the central portion of the mandrel, and an outer profile of the second shoulder may be defined by a third edge having the first outer diameter and a fourth edge having the second outer diameter. The buoyant material may contact and be axially retained by and between the first and second shoulders.

The present disclosure also introduces a method comprising: assembling a buoyancy apparatus for connection within a tool string conveyable within a wellbore extending into a subterranean formation, wherein assembling the buoyancy apparatus comprises: attaching an upper portion of an outer shell to an upper end of a mandrel; then connecting an upper field connector to the upper end of the mandrel, wherein the upper field connector is operable for connection with a first portion of the tool string; then positioning a buoyant material around the mandrel; then positioning a central portion of the outer shell around the buoyant material; then attaching a lower portion of the outer shell to a lower end of the mandrel; and then connecting a lower field connector to the lower end of the mandrel.

Attaching the upper portion of the outer shell to the upper end of the mandrel may comprise threading the upper portion of the outer shell onto the upper end of the mandrel.

Connecting the upper field connector to the upper end of the mandrel may comprise engaging corresponding threads of the upper field connector and the upper end of the mandrel. Connecting the lower field connector to the lower end of the mandrel may comprise engaging corresponding threads of the lower field connector and the lower end of the mandrel.

Attaching the upper field connector to the upper end of the mandrel may retain the upper portion of the outer shell from moving axially upward relative to the upper end of the mandrel. Attaching the lower field connector to the lower end of the mandrel may retain the lower portion of the outer shell from moving axially downward relative to the lower end of the mandrel.

The buoyant material may have a substantially annular shape, and positioning the annular-shaped buoyant material around the mandrel may comprise sliding the annular-shaped buoyant material over the lower end of the mandrel until the annular-shaped buoyant material contacts the upper portion of the outer shell.

Positioning the central portion of the outer shell around the buoyant material may comprise sliding the central portion of the outer shell over the lower end of the mandrel and the buoyant material until the central portion of the outer shell contacts the upper portion of the outer shell.

Attaching the lower portion of the outer shell to the lower end of the mandrel may comprise threading the lower portion of the outer shell onto the lower end of the mandrel.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A tool string for operation within a wellbore that extends from a wellsite surface into a subterranean formation, wherein the tool string is suspended within the wellbore via conveyance means operably coupled with surface equipment disposed at the wellsite surface, and wherein the tool string comprises:

a first portion comprising at least one first electrical conductor in electrical communication with the surface equipment;

a second portion comprising at least one second electrical conductor in electrical communication with the surface equipment; and a buoyancy apparatus coupled between the first and second portions and introducing buoyancy to the tool string to oppose the weight of the tool string when the tool string is submerged within a wellbore fluid in the wellbore, wherein the buoyancy apparatus comprises:

at least one third electrical conductor establishing electrical communication between the first and second electrical conductors;

an upper field connector physically and fluidly coupling the buoyancy apparatus with the first portion of the tool string;

a lower field connector physically and fluidly coupling the buoyancy apparatus with the second portion of the tool string;

a mandrel extending axially along the length of the buoyancy apparatus between the upper field connector and the lower field connector, wherein the mandrel is substantially tubular, and wherein the mandrel comprises:

an upper mandrel portion coupled with the upper field connector;

a lower mandrel portion coupled with the lower field connector; and a central mandrel portion extending between the upper and lower mandrel portions, wherein:

at least one central passage extends axially along the length of the upper, lower, and central mandrel portions;

the upper and lower mandrel portions have an outer diameter that is larger than an outer diameter of the central mandrel portion; and the at least one third electrical conductor extends through the central passage;

an outer shell circumferentially extending about the central mandrel portion between the upper and lower mandrel portions, wherein the outer shell comprises:

an upper shell portion;

a lower shell portion; and a central shell portion extending between the upper and lower shell portions, wherein:

the upper and lower shell portions are rounded, sloped, tapered, or slanted, with respect to a central longitudinal axis of the buoyancy apparatus;

the central shell portion is substantially cylindrical and comprises a plurality of openings permitting flow of the wellbore fluid into an annular space between the outer shell and the mandrel; and the central shell portion has an outer diameter that is larger than the outer diameters of the upper, lower, and central mandrel portions, thus partially defining the annular space; and a buoyant material substantially filling the annular space, wherein the buoyant material comprises syntactic foam containing hollow particles, and wherein the buoyant material is retained in position by the outer shell, an upper shoulder extending radially between the central mandrel portion and the upper mandrel portion, and a lower shoulder extending radially between the central mandrel portion and the lower mandrel portion.

* * * * *